US005104336A

United States Patent [19]

Hatanaka et al.

[11] Patent Number: 5,104,336

[45] Date of Patent: Apr. 14, 1992

[54] FLAT CABLE CONNECTOR

[75] Inventors: Mutsuo Hatanaka; Akira Shimada, both of Tama, Japan

[73] Assignee: Kel Corporation, Tokyo, Japan

[21] Appl. No.: 602,134

[22] Filed: Oct. 23, 1990

[51] Int. Cl.[5] ..... H01R 4/24

[52] U.S. Cl. ..... 439/404; 439/417

[58] Field of Search ..... 439/389–425

[56] References Cited

U.S. PATENT DOCUMENTS 4,753,608 6/1988 Yamaguchi ..... 439/417

*Primary Examiner*—Joseph H. McGlynn
*Attorney, Agent, or Firm*—Robert W. J. Usher

[57] ABSTRACT

A flat cable connector for terminating respective individual conductors of first and second flat cables stacked in overlapping relationship one above the other has a cable connecting face which is stepped to provide lower and upper for corresponding termination zones and a first and second series of terminals anchored in the housing and having pressure connecting portions protruding into such zones for connection to the first and second flat cables, respectively, with conductor connecting portions of some of the terminals of the second series upstanding, unsupported, from the lower level. A first cable engaging cover member is formed with guide surfaces providing guiding engagement with unsupported lengths of the second series of conductor connecting portions during termination movement, obviating risk of damage and deformation thereof. The step may be a separately formed insert mounted on the housing prior to termination, thereby simplifying manufacture and assembly of terminals in the housing.

9 Claims, 18 Drawing Sheets

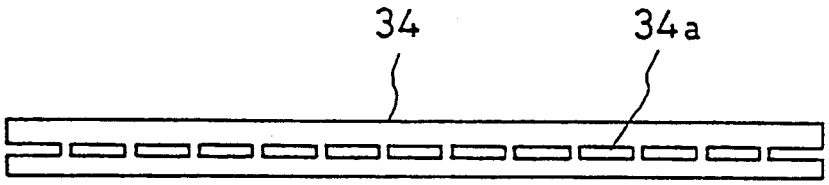
FIG. 12 (a)
FIG. 12 (b)
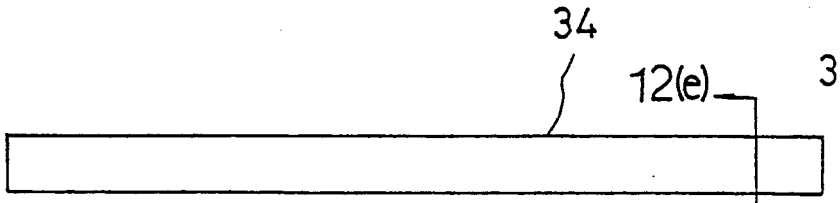
FIG. 12 (c)
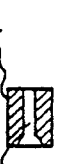
FIG. 12 (e)
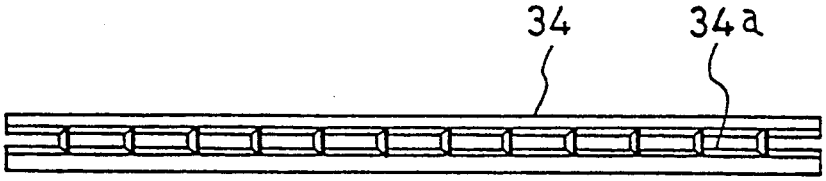
FIG. 12 (d)

FLAT CABLE CONNECTOR

FIELD OF THE INVENTION

The invention re to flat cable connectors for establishing permanent connection with respective individual conductors of end portions of first and second flat cables stacked in overlapping relation one above the other.

BACKGROUND OF THE INVENTION

In one type of flat cable connector, known for example from Japanese Patent Application 61-17831, in order to obtain a high density of connection, a first and a second series of terminals have conductor connecting portions of different lengths and are anchored or implanted to extend along opposite lateral sides of an elongate insulating housing so that the conductor connecting portions of the first and second series of terminals protrude above a conductor connecting face of the housing by different amounts into lower and upper termination levels or zones, respectively, for pressure connection with conductors of the first and second cables, respectively.

Termination is effected by aligning a cable end portion with the cable engaging face of one cover member and overlaying another cover member thereon, thereby trapping the cable between the cable engaging faces of the cover members and by then aligning the first cable on an opposite, cable engaging face of the other cover member forming a subassembly for terminating engagement against the cable connecting face of the housing. The one cover member has apertures or slots for receiving respective conductor connecting portions of only the second series of terminals, the other cover member having a lateral width sufficient to cover the cable connecting face of the housing and apertures or slots for receiving respective conductor connecting portions of both series of terminals, respectively. Termination can be effected by moving the cable connecting housing face carrying the conductor connecting portions and the subassembly relatively together to drive the conductor connecting portions of both series into corresponding apertures or slots of the other cover member, with those of the second series also protruding into the slots of the one cover member, into pressure connection with the individual conductors of the cables.

Although a high density connection can be achieved by connectors of the above-described type, particularly where the conductor connecting portions of alternate terminals of each series are staggered to form four rows, the step of overlaying the other cover member on the cable tends to obscure the underlying cable and cover so that the correct pitch alignment of the cable and cover members is then difficult to ascertain visually often requiring removal of the other cover member for verification, which is a cumbersome and time consuming procedure, tending to increase applied costs.

In addition, the extended lengths of the conductor connecting portions of the second series of terminals are unsupported by the housing and vulnerable to damage both during handling, transportation and by forces arising from the terminating operation. Consequential deformation of the conductor connecting portions results in misalignment with the individual conductors with consequentially poor or unreliable connection.

In another prior connector known from Japanese Patent Application 61-232837, the cable connecting face of the housing is divided laterally by a longitudinally extending step into lower and upper cable supporting levels corresponding with lower and upper termination zones enabling the other cover member to be of less lateral width so as not to obscure the alignment of the cable and the one cover member when overlaid thereon. However, extended length, conductor connecting portions of the second series of terminals remain incompletely supported by the housing thus remaining subject to damage and deformation both during and after the terminating operation.

Furthermore, the lateral distance between the conductor connecting portions of the first series of terminals and the end of the cable is relatively short, resulting in problems causing increased risk of deformation of the core conductors during termination, as explained below.

In a further example of prior connector disclosed in Japanese Utility Model publication 60-110985, conductor connecting portions of extended lengths also lack sufficient support resulting in similar disadvantages to the aforementioned. Another example, U.S. Pat. No. 4,143,9352 to Goodman teaches a different approach which, nevertheless, cannot provide the necessary high density of connection or compactness.

OBJECTS OF THE INVENTION

An object of the invention is to provide a flat cable connector of the above-mentioned type which overcomes at least some of the above-mentioned disadvantages in providing support for the conductor connecting portions of extended length during termination.

A further object of the invention is to provide a flat cable connector which affords support for such conductor connecting portions both during and subsequent to termination.

An additional object of the invention is to provide a flat cable connector which provides a highly reliable connection at close pitch by avoiding wire deformation during termination.

A further object of the invention is to provide a flat cable connector which is of compact size and is adapted for economical manufacture and assembly at high volume using mass production techniques and which facilitates speedy termination of cables at low applied cost.

SUMMARY OF THE INVENTION

According to one aspect of the invention there is provided a flat cable connector for establishing permanent connection with respective individual conductors of first and second flat cables having end portions stacked in overlapping relation one above the other comprising:

an elongate insulating housing having an elongate cable connection face and a contact face, the cable connecting face being divided laterally by a longitudinally extending step into lower and upper cable supporting levels providing longitudinally extending lower and upper cable termination zones;

a first and a second series of terminals each stamped and formed in one piece with conductor connecting and contact portions adjacent respective opposite ends thereof, each conductor connecting portion comprising a plate formed with a wire receiving slot and the conductor connection portions of terminals of the second series being longer than those of the first series, the terminals being anchored in the housing with the conductor connecting portions of the first and second series protruding above the lower and upper levels of the cable connecting face, respectively, with respective conductor receiving slots in lower and upper termination zones respectively, at least some of the conductor connecting portions of the second series being arranged in a row upstanding from the lower level and having portions of extended length unsupported by the housing in at least one lateral direction towards the first series of terminals;

first and second, elongate, cover members for receipt in the lower and upper termination zones, respectively, and having cable engaging faces with means for engaging the first and second cables, respectively, with an end portion of the second cable trapped between the second and first cover members and the upper level of the cable connecting face, and an end portion of the first cable trapped between the first cover member and the lower level of the cable connecting face, to force respective conductors thereof into respective wire receiving slots of terminals of the first and second series on terminating movement of the housing and cables relatively together, the first cover member being of less lateral width than the cable connecting face and having terminal guide surface means located therealong, extending transversely of the cable engaging face such that, during terminating movement, the terminal guide surface means of the first cover member is closely adjacent the unsupported lengths of the conductor connecting portions of the row for sliding engagement therewith throughout their terminating movement relatively towards the second cable and providing supporting engagement therewith after terminating movement.

The guiding and support of the conductor connecting portion provided by the first cover member eliminates the risk of deformation both during and after termination.

Preferably, the terminal guide surface means is formed by a longitudinally extending, laterally facing, free edge portion of the first cover member and a series of guide projections extend laterally from such edge portion at longitudinally spaced intervals corresponding to the longitudinal spacing of the conductor connecting portions of the terminals of the second series and are received between unsupported, longitudinally facing edges of adjacent conductor connecting portions of the terminals forming transversely extending, terminal receiving, channel section guide surfaces.

Thus, guidance and support is provided by the first cover member in a lateral and in both longitudinal directions of the housing, further assuring reliability of connection and enabling the housing structure adjacent the cable connecting face to be simplified facilitating assembly of the terminals in the housing in a force fit by insertion through the cable connecting face.

In one preferred construction, the row of conductor connecting portions upstanding from the lower level are spaced laterally from the step and the terminal guide surface means are formed by edges of respective apertures extending through the first cover member in a row aligned for receiving the respective conductor connecting portions of the row of the second series of terminals.

In a further preferred construction, other of the conductor connecting portions of the second series of terminals are arranged in another row and have portions of extended length upstanding, unsupported by the housing, from the lower level adjacent the step with unsupported sides exposed towards the one row, the first cover member having further terminal guide surface means extending transversely of the cable engaging face and located along the cover member adjacent the unsupported sides for sliding engagement therewith throughout terminating movement and for supporting engagement therewith after termination.

In a modification, the step providing the upper level is formed as a separate insert and mounted on the cable connecting face prior to termination. This can simplify manufacture and assembly of the connector while providing support for some terminals of the second series upstanding from sockets in the surface of the lower level of the cable connecting face of the housing.

BRIEF DESCRIPTION OF THE DRAWINGS

Specific embodiments of the invention will now be described by way of example only with reference to the accompanying drawings in which:

FIGS. 12(*a*),(*b*),(*c*),(*d*) and (*e*) are, respectively, plan, end, side elevational, underplan and cross sectional views along line V—V of FIG. 12(*c*), of the fourth example of invention shown in FIG. 11;

FIGS. 12(*a*),(*b*),(*c*),(*d*) and (*e*) are, respectively, plan, side elevational, underplan, end elevational and cross sectional view along line R—R of FIG. 13(*b*), showing a first cover member of a fifth example of connector according to the invention;

As shown in FIGS. 16–18, in a prior flat cable connector described in Japanese Patent Application 61-17831, a connector receptacle 30 comprises a generally rectangular insulating housing block 31 in which a first and a second of series of terminals 362 and 361, respectively are anchored or implanted in a force fit with the housing at 31*a*, at medial portions thereof, by insertion through an upper cable connecting face so that contact portions 362*b* and 361*b*, respectively, are located in spaced apart relation adjacent a mating face and conductor connecting portions 362*a* and 361*a* respectively, upstand from the cable connecting face. Alternate conductor connecting portions of each series are staggered laterally of the housing block zig-zag fashion to form equispaced rows. Longitudinally adjacent conductor connecting portions are offset by the pitch of the flat cables 351 and 352, (1.27 mm), and by one half the conductor pitch, (0.635 mm), between the first and third rows and between the second and fourth rows. Each conductor connecting portion comprises a metal plate formed with a wire receiving slot into which each core conductor of the flat cables can be inserted to form a pressure connection so that the core conductors of flat cables 351 and 352 can be pressure connected to the conductor connecting parts 361*a* and 362*a* of the first and second series, respectively, using a pressing implement 34 to urge first and second cover members 32 and 33, entrapping the cables, relatively towards the cable engaging face.

Figure 15:
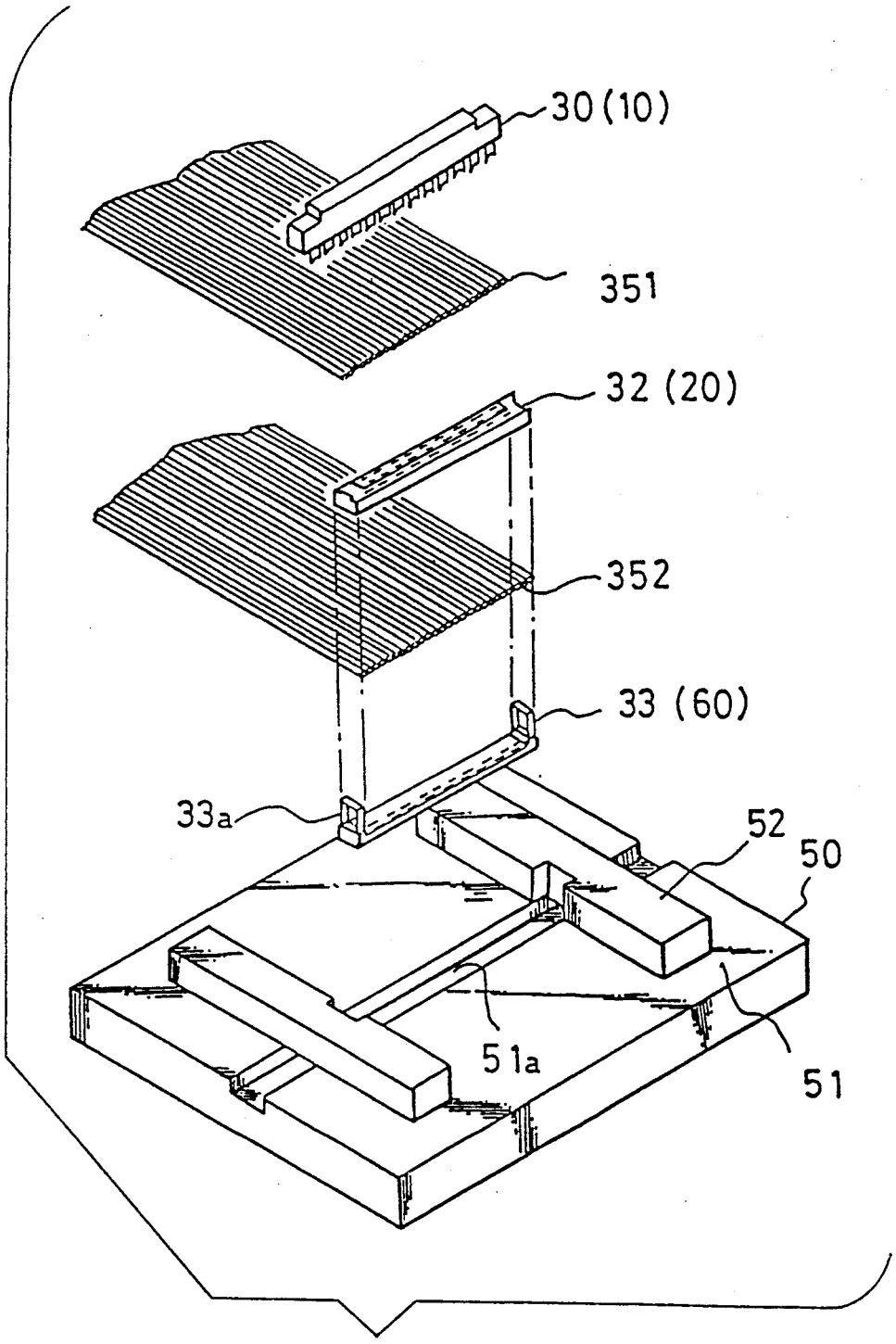
FIG. 15 is a diagrammatic exploded perspective view illustrating the terminating or connection operation of the connectors according to the invention.
Figure 16:
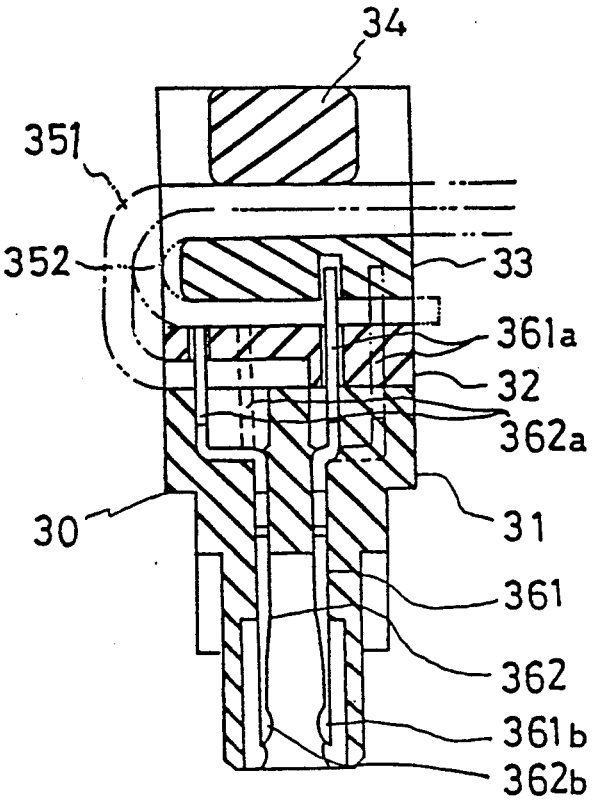
FIG. 16 is a cross sectional view taken in a transverse vertical plane of a prior flat cable connector.
Figure 18:
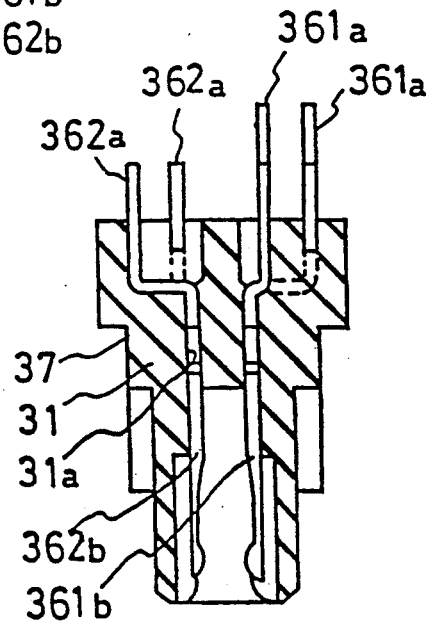
Figure 17A:
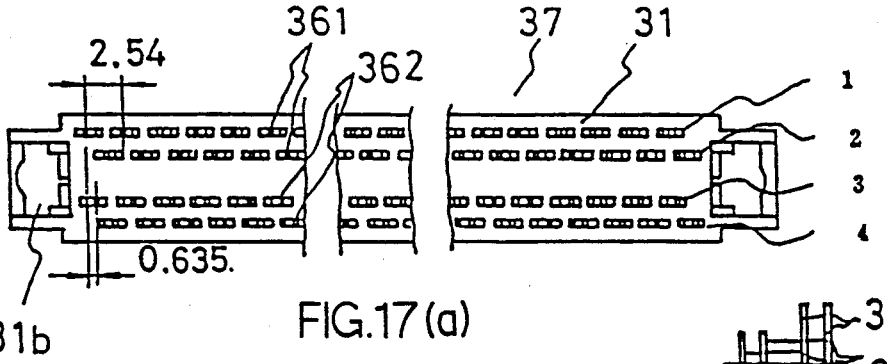
FIGS. 17 (*a*),(*b*),(*c*),and (*d*) are plan, side elevational, underplan and elevational views of the prior connector shown in FIG. 16; and, FIG. 18 is a cross sectional view similar to FIG. 16 but with the cover members and cable omitted.
Figure 17D:
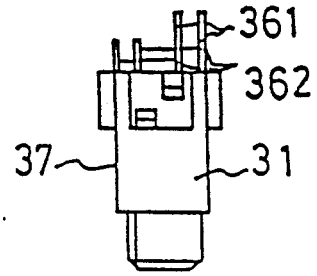
Figure 17B:
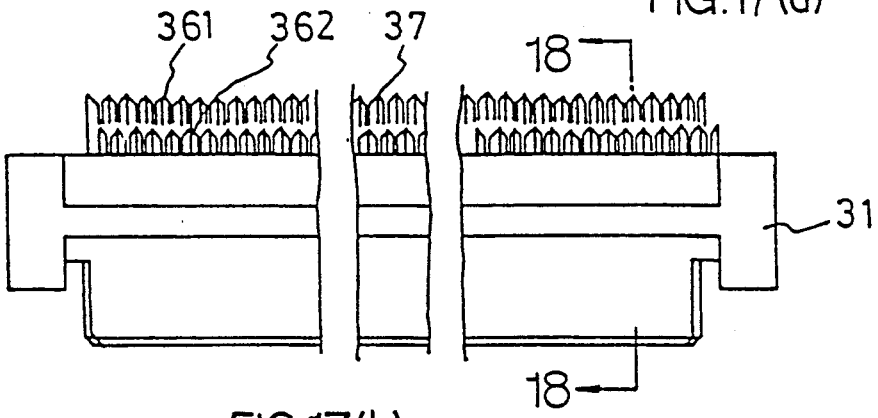
Figure 17C:
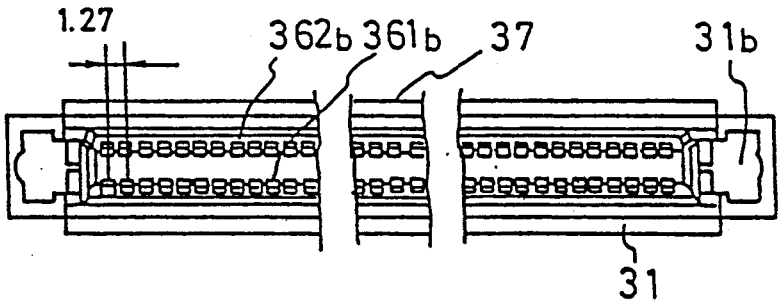

In one method of terminating the flat cables 351 and 352, for example, as shown in FIG. 15, the cover member 33 is inserted into a groove 51*a*, with stops 33*a*, formed in a base 51 of a connecting jig 50, engaging end positioning plates 52. The flat cable 352 is located in precise alignment on the cover 33 and, the cover 32 and the flat cable 351 are then placed successively on flat cable 352; finally, the connector 30 is pressed down by a hand press, not shown, forcing the conductor connecting portions 361*a* and 362*a* into pressure connection with the respective individual core conductors of the flat cables 351 and 352, respectively.

However, the disadvantage arises that overlying the cover member 32 o the flat cable 352 tends to obscure the flat cable and underlying cover member 33 making it difficult to ascertain the correct alignment of the flat cable with the cover member necessitating very precise initial positioning of the flat cable 352 on the cover member 33 and, in some cases, subsequent removal of the cover member 32 from the flat cable to reconfirm correct alignment thereof which results in a cumbersome and time consuming procedure and risk of faulty connection.

Furthermore, as a result of the conductor connecting portions of the second series of terminals being required to connect to flat cable 352 stacked at a higher level termination zone than flat cable 351, they have a relatively long unsupported length upstanding from the cable engaging face, increasing risk of their deformation by forces arising during termination or by handling or transportation of the connector. Even a relatively small deformation of the conductor connecting portions will result in misalignment of their centers with the centers of the core conductors of the cable, preventing reliable connection therewith. In extreme cases almost none of the core conductors are connected resulting in a poor degree of reliability.

As mentioned above, prior attempts to solve or ameliorate this problem by providing an insulating housing in which the cable connecting face is divided laterally by a longitudinally extending step into lower and upper cable supporting levels providing lower and upper termination zones are not wholly satisfactory either because adequate support for the longer conductor connecting portions of the second series of terminals has still not been obtained, or because other disadvantages, either in compactness, manufacture or assembly, have been introduced.

According to a first example of the invention shown in FIGS. 1–5, a flat cable connector 10 comprises an insulating housing 1, for terminals 6, 7, 8 and 9, first and second cover members 20 and 60, respectively, and a pressing implement 70, also providing strain relief. The housing 1 is molded in one piece of insulating material into generally rectangular shape having an elongate cable connecting face 2 divided laterally by a longitudinally extending step into upper and lower cable supporting levels 3 and 4, respectively, corresponding to upper and lower cable termination zones. A first series of terminal receiving cavities 11 are arranged to open to the surface of the lower level 4 in zig-zag distribution at equal spacings from each other for receiving the terminals 8 and 9 arranged in two rows. Terminal receiving cavities 12 open to the surface of the upper level 3 at equally spaced intervals receiving the terminals 6 as a single row while terminal receiving cavities 13 open to the surface of the lower level 4 adjacent a vertically extending wall of the step for receiving the terminals 7 with conductor connecting portions thereof abutting the vertical wall. The terminal receiving cavities 13 and 12 are also arranged in zig-zag fashion to enable the necessary close pitch connection to the cable.

Figure 3:
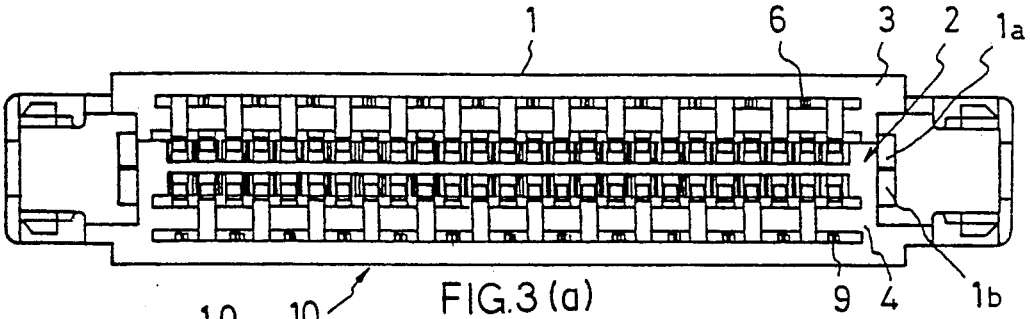
FIGS. 3(*a*),(*b*),(*c*), and (*d*) are, respectively, plan, side elevational underplan and end elevational views of the insulating housing of the connector of FIG. 1.
Figure 3:
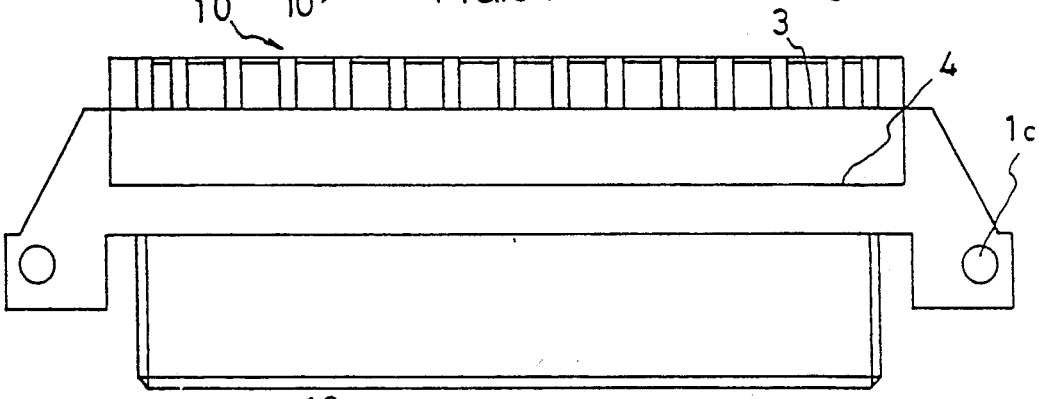
Figure 3:
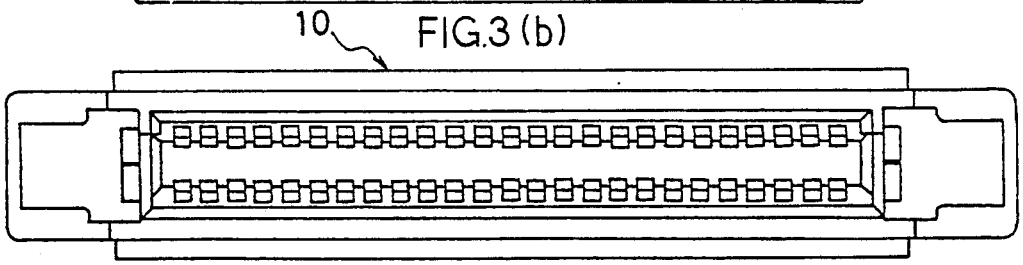
Figure 3:
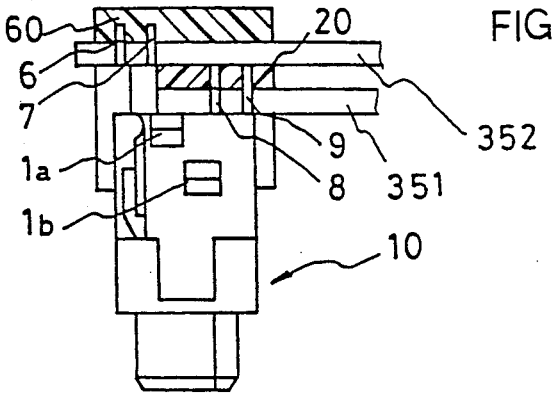
Figure 4A:
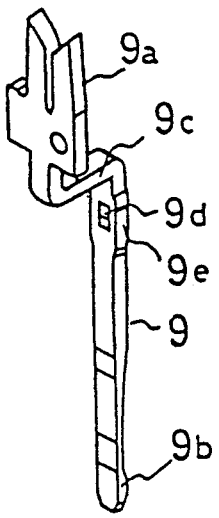
FIGS. 4(*a*),(*b*),(*c*), and (*d*) are perspective views of four different terminals of the connector.
Figure 4B:
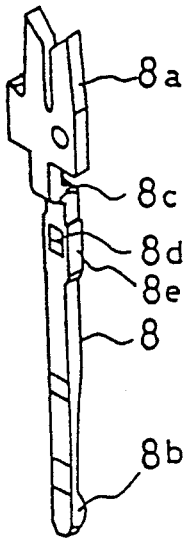
Figure 4C:
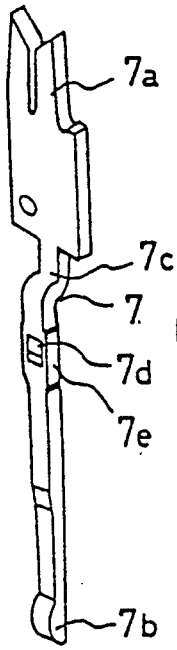
Figure 4D:
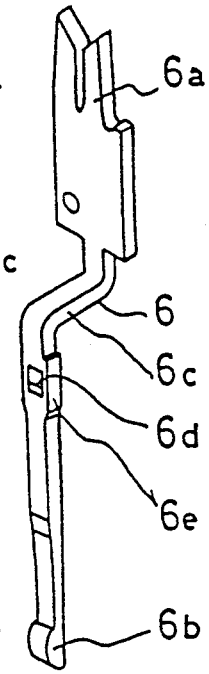

As shown particularly in FIG. 3(*d*), pin receiving sockets 1*a* and 1*b* are provided in vertically and laterally spaced locations on opposite end surfaces of the connector housing for receiving a stop projection of a stop frame 61 of the second connector cover 60 in intermediate and final positions, respectively, during termination. A pin receiving aperture 1*c* is provided on lateral sides of extreme opposite ends of the connector for supporting a locking lever 19, when inserted into the side of a header, not shown.

As shown more particularly in FIGS. 4(*a*)–(*d*). in which similar parts are identified by similar reference letters, each of the contacts 6–9 is stamped and formed from a single piece of sheet metal stock, the contacts comprising conductor connecting portions 6*a*–9*a* and contact portions 6*b*–9*b* at respective opposite ends joined by stems comprising crank portions 6*c*–9*c* and anchoring portions, constituted by portions 6*e*–9*e* of enlarged width and protruding stops 6*d*–9*d* for anchoring engagement with the housing in a force fit. Each conductor connecting portion comprises a generally plate-like part into a free end of which extends a wire receiving slot defining a generally U-shape pressure connecting structure. The plate-like portions of the terminals 6 and 7 are longer than the corresponding portions of the terminals 8 and 9 while the crank-like portions of the terminals 6 and 9 are longer than the corresponding portions of the terminals 7 and 8.

Figure 5:
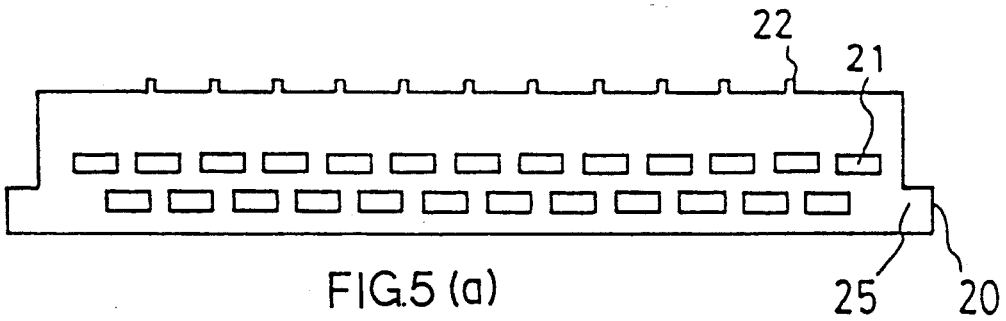
FIGS. 5(*a*),(*b*),(*c*),(*d*) and (*e*) are, respectively, plan, front elevational, underplan, end elevational and cross sectional views along line X—X of FIG. 5(*b*), of a first cover member of the connector of FIG. 1.
Figure 5:
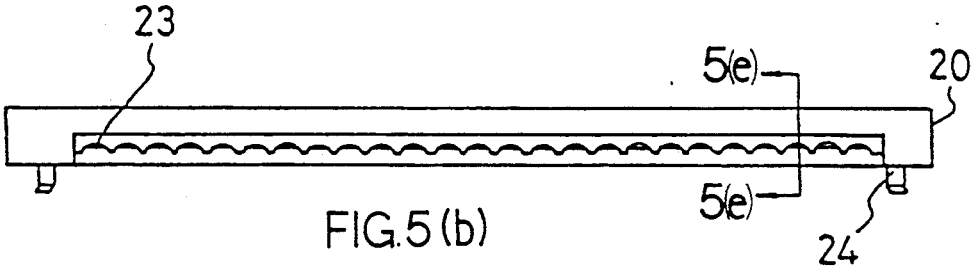
Figure 5:
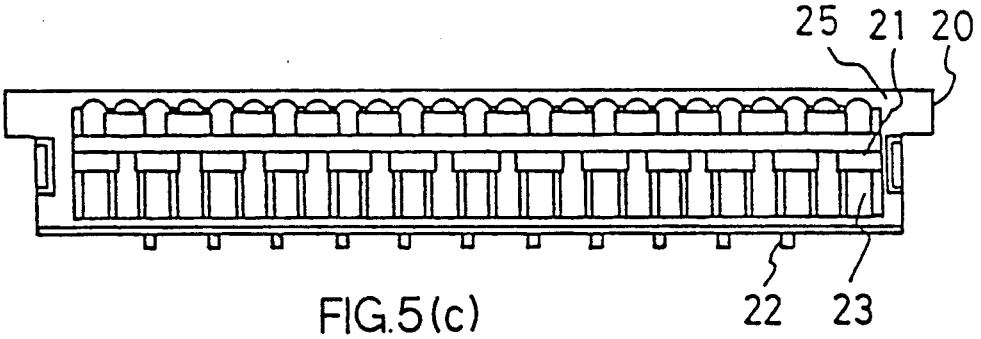
Figure 5:
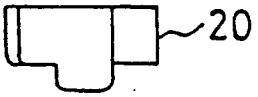
Figure 5:
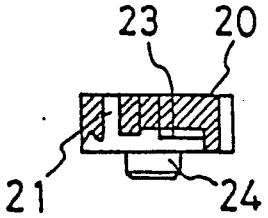

As shown particularly in FIGS. 5(*a*)–5(*e*), the first cover member is molded in one piece with conductor connecting portion receiving apertures 21 extending completely through the cover member from an upper face to a lower, cable connecting face, and arranged in zig-zag fashion, aligned to receive conductor connecting portions 8*a* and 9*a* of the contacts 8 and 9 upstanding from the lower level. The cover member is formed along a longitudinally extending edge thereof, with a terminal guide surface, comprising a series of guide projections extending laterally from such edge, forming transversely extending, terminal guiding, channel section guide surfaces for engagement with the unsupported surface and opposite vertically extending edges of the plate-like conductor connecting portions 7*a*, during and after termination, to provide guiding and support during and after termination. Cable receiving grooves 23 extend transversely along the cable engaging face ensuring precise alignment of the cable, and projections 24, which may be of boss form, extend from respective opposite ends of the cable engaging face for receipt in sockets formed in the surface of the lower level of the cable connecting face of the housing. Guiding lugs 20, 25 for guiding the stop frame 61 of the second cover member 60 described below are also formed on the opposite ends of the first cover member.

Figure 1:
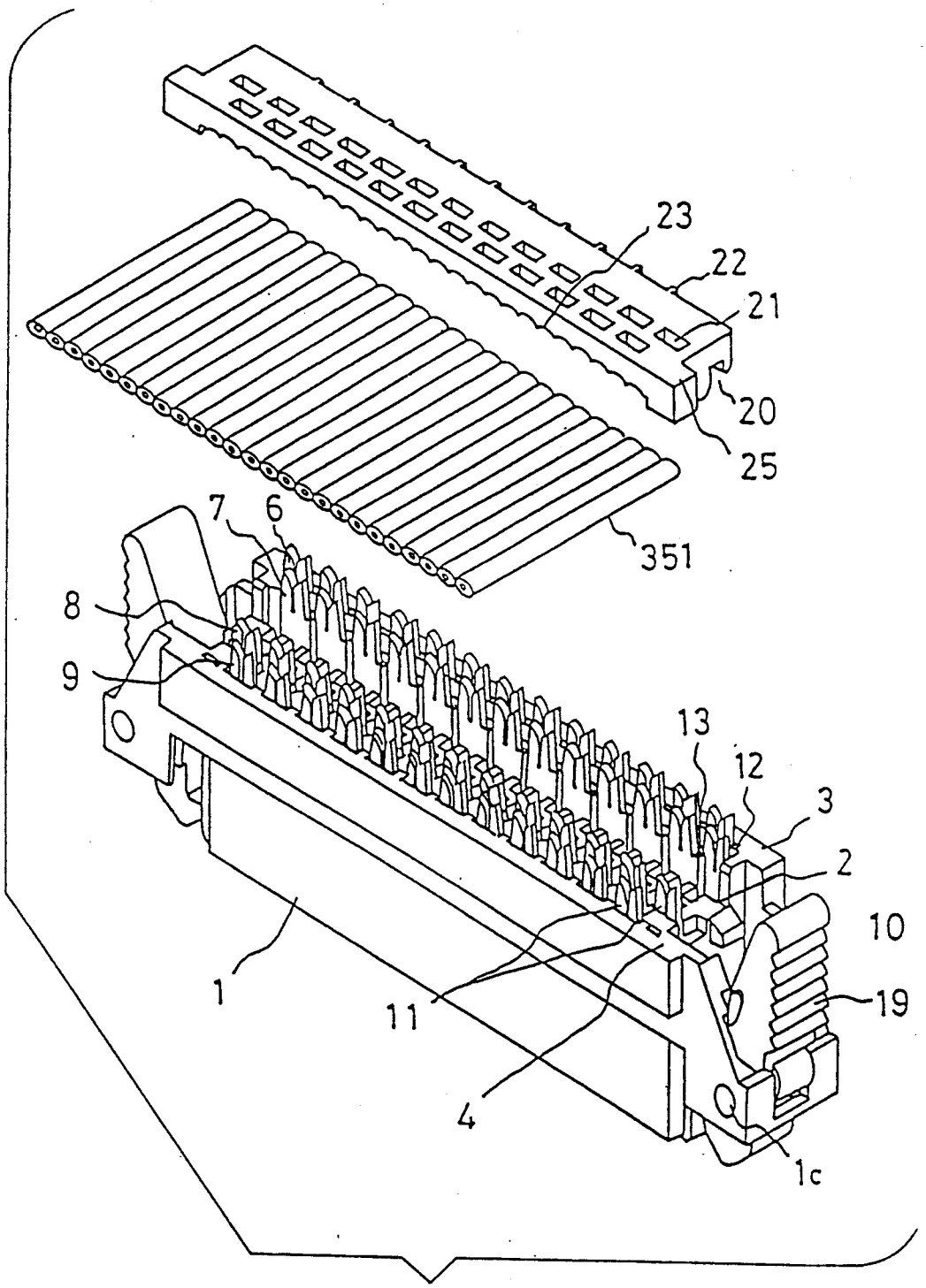
FIG. 1(*a*) and (*b*) is a diagrammatic, exploded perspective view of a first embodiment of flat cable connector according to the invention.
Figure 1B:
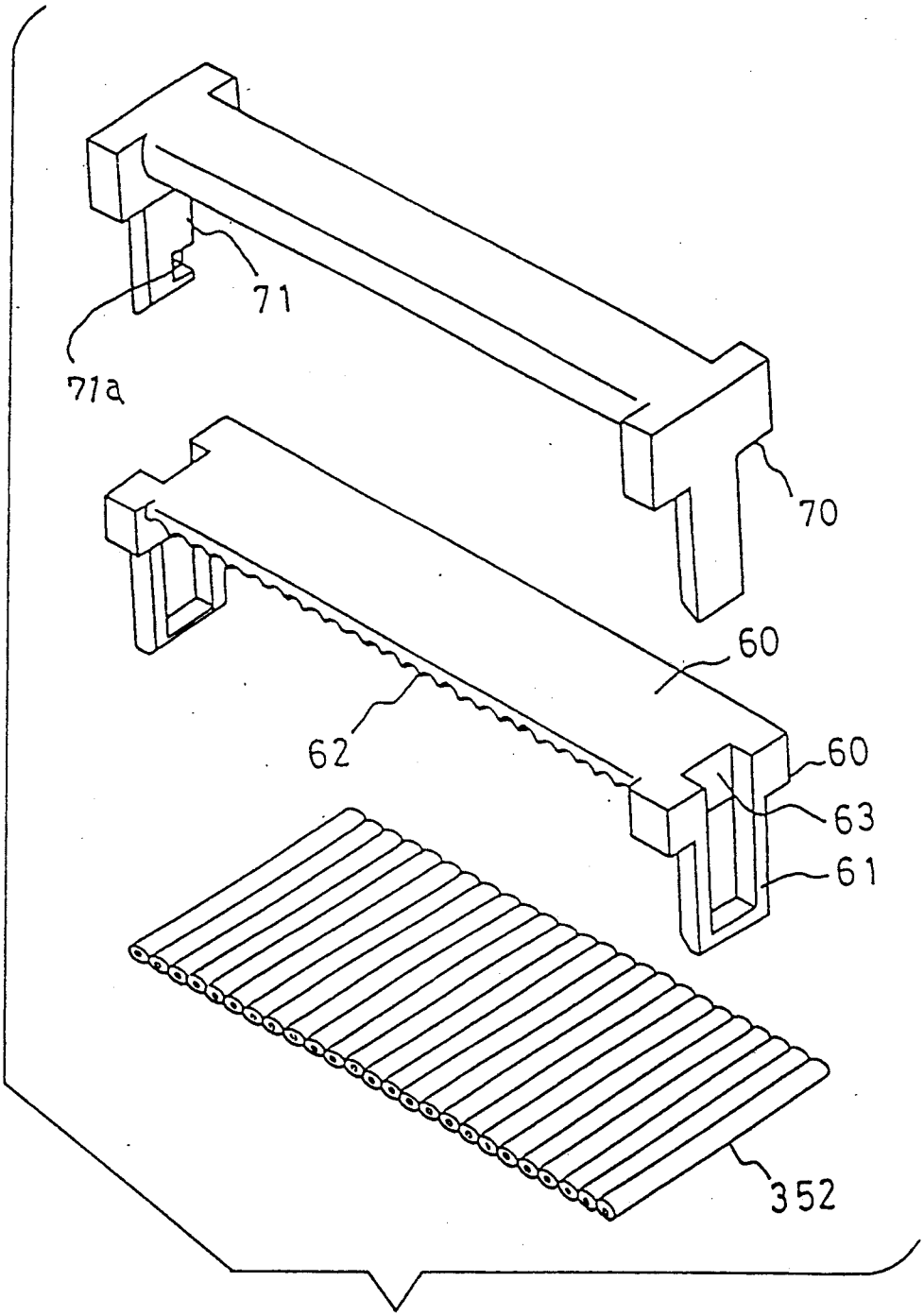

The second cover member 60 is also molded in one piece with hasp like stop frames 61 depending from opposite axial ends, as shown in FIG. 1, and cable locating grooves 62 extending transversely across the lower surface. Vertically extending grooves 63 are also formed in the opposite ends of the second cover member for receiving, in guiding engagement, guide pieces 71 which depend from opposite ends of pressing implement 70.

The flat cables 351 and 352 both have a pitch of 1.27 mm, for example.

The flat cables 351 and 352 are terminated in the first example of connector in a similar manner to that described above in relation to the prior art. As shown in FIG. 15, the second cover member 60 is inserted into the groove 51A of the base 51 of the connecting groove 50, the flat cable 352 is located carefully on the locating grooves 62 and the first cover member 20 is then located on the flat cable 352. The cable cover 20 is slid downwardly while fitting guide lugs 25 onto the outside of the stop frame 61 of the cable cover 60. Thus positioned, the projections 22 will be aligned between adjacent conductor connection portions of terminals 7. The flat cable 351 is then carefully located on the cable locating groove 23 of the cover member 20 and the connector 10 is then pressed down using a hand press not shown, with the conductor connecting portions 6*a* to 9*a* of the terminals facing downward, so that respective individual conductors of cables 351 and 352 are driven into the conductor receiving slots of conductor receiving portions 8*a* and 9*a* and 6*a* and 7*a*, respectively, terminating the cables.

As the first cover member is of less lateral width than the second cable cover, during this terminating operation, pitch offsets of the flat cable 352 add the cover member 60 can be ascertained by sight even when the cable cover 20 overlies the flat cable 352 on the cable cover 60, ensuring a more reliable assembly operation than in the prior connectors.

In addition, the longer conductor connecting portions 6*a* are supported along their extended lengths by the portion of the housing forming the step and they protrude above the upper level by the same amount as the conductor connecting portions 8*a* and 9*a* protrude above the lower level. In addition, as the terminating movement of the individual conductors 352*a* of the flat cable 352 in a direction longitudinally of the cable engaging face is regulated by the adjacent guide projections 22 on the cable cover 20, there is little deformation of the conductor connecting portions 6*a* and 7*a* of the contact 6 and 7 even if a stress likely to cause deformation is applied during the terminating movement. Furthermore, during the terminating movement the base portions of the channel section guide means defined by the edge of the first cover member and the guiding projections provides sliding guiding engagement with the unsupported faces of the conductor connecting portions 7*a* of the terminals 7 ensuring accurate guiding of such portions into slots 61*a* of the second cover member 60, thereafter also holding such portions 7*a* securely between the first cover member and the vertical wall of the step of the connector.

Figure 2:
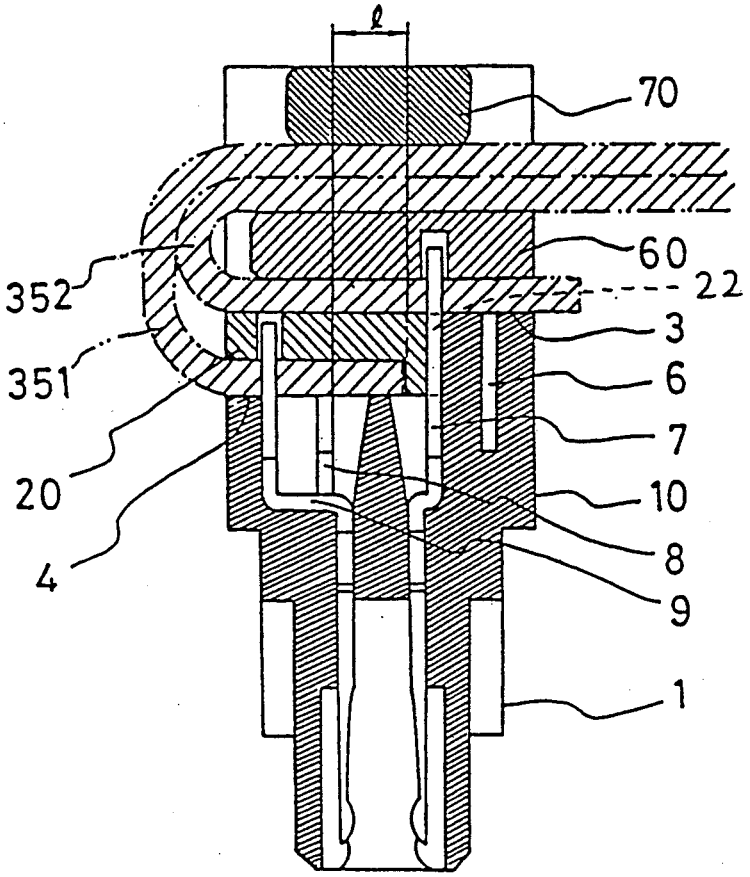
FIG. 2 is a cross sectional view taken in a vertical transverse plane of the connector of FIG. 1.
Figure 6A:
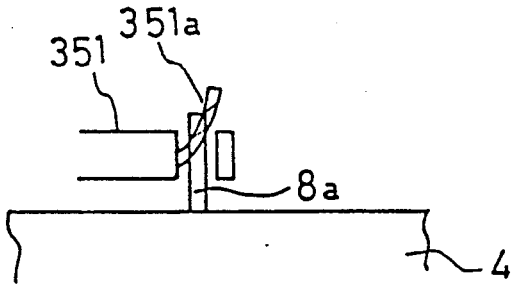
FIGS. 6(*a*) and (*b*) are diagrammatic views illustrating the connection of a terminal to a flat cable conductor possibly occurring in a prior connector.
Figure 6B:
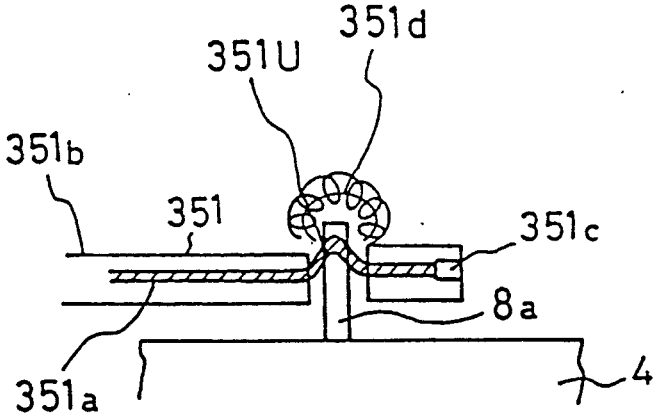

In addition, as the molding which forms the step does not extend between the conductor connecting portion 7*a* and the side of the cover member 20, the surplus length dimension '1' shown in FIG. 2, (the distance between the position of the terminal a and the position at which the free end of the cover member 20), is made large, affording a connection of high reliability. As explained with reference to FIGS. 6*a* and 6*b*, if the dimension '1' were short, the tip of the core conductor 351*a* of the flat cable 351 would be deformed upwardly with respect to the conductor connecting portion 8*a* as shown in FIG. 6*a*, resulting in an imperfect connection or, as shown in FIG. 6*b*, the core conductor 351*a* would be deformed upwardly into a generally U-shape, as shown by 351*u* and the insulating sheath 351*b* would be cut by the conductor connection portion 8*a* with the result that the tip of the core conductor 351*a* would be withdrawn inside the sheath as shown at 351*c*, 351*d* indicating the expelled insulating covering.

The guidance of the contacts 7 between the adjacent guide projections 22 also assures that flat cable connectors with many terminals can be utilized.

Additionally, the increase in the length dimension '1' enables a relatively wide cable member 20 to be utilized with the result that the cable 351 is guided to approximately the same degree as in the conventional flat cable connector.

Figure 7:
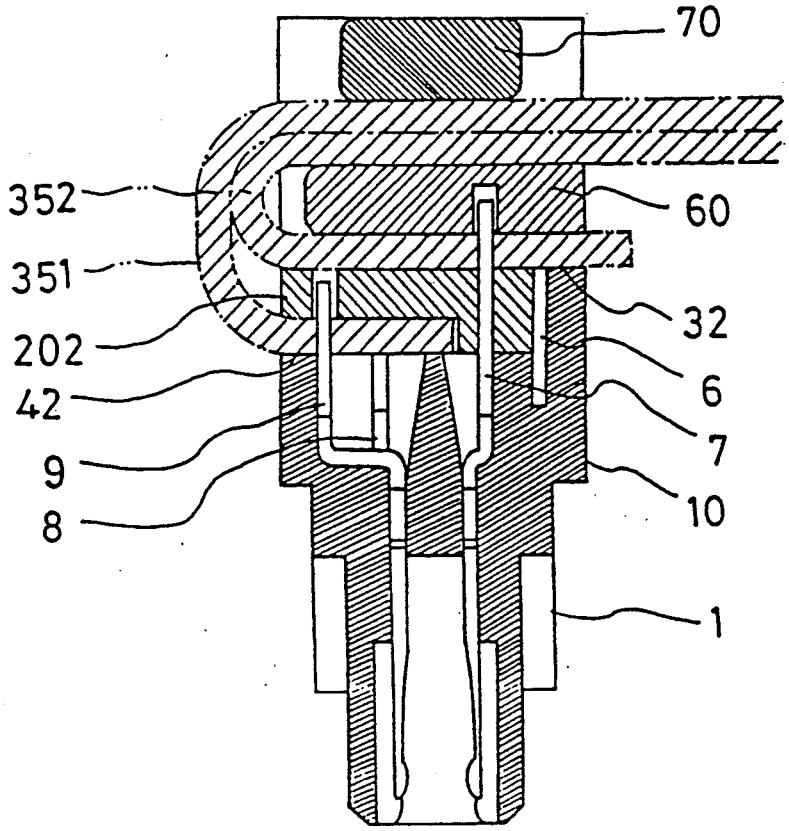
FIG. 7 is a diagrammatic, cross sectional view taken in a vertical transverse plane of a second example of connector according to the invention.
Figure 8A:
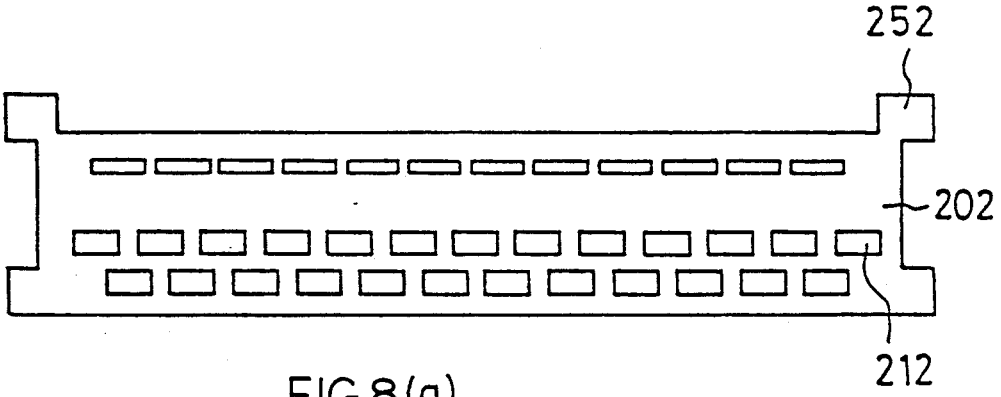
FIGS. 8(*a*),(*b*),(*c*),(*d*) and (*e*) are, respectively, plan, side elevational, underplan, end elevational and cross sectional views taken along line Y—Y of FIG. 8(*b*), of a first cover member of the second example of connector shown in FIG. 7.
Figure 8B:
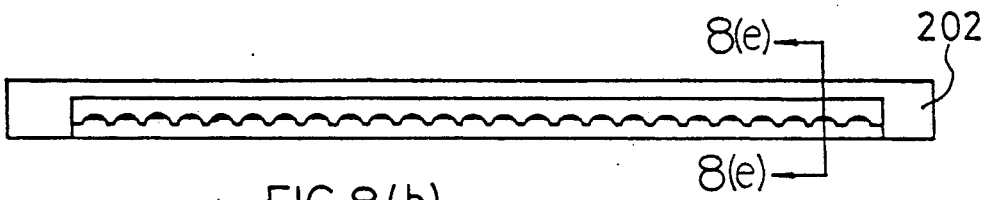
Figure 8C:
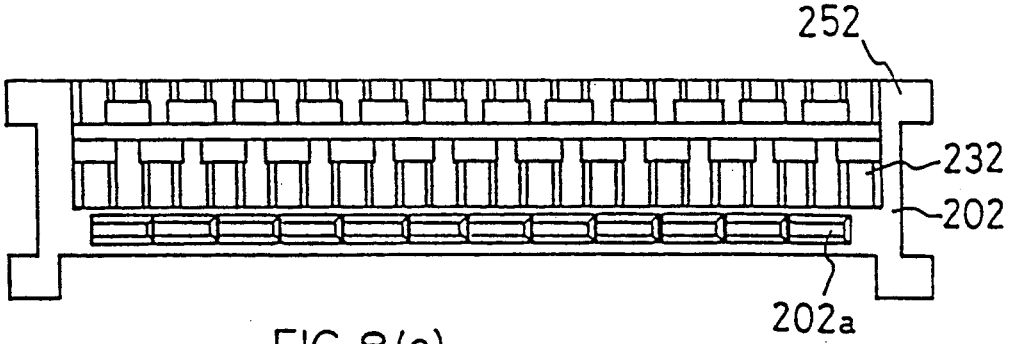
Figure 8D:
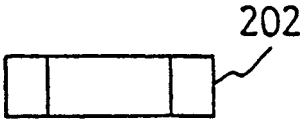
Figure 8E:
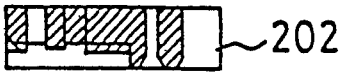

According to a second example of the invention shown in FIGS. 7 and 8, the step is formed on the cable engaging face on a side of the terminal 6 remote from the terminal 7, which is, therefore, spaced therefrom and the conductor connecting portion of which upstands freely from the cable engaging face prior to termination. Guide protrusions (not shown) by which the conductor connecting portions 6*a* of the contacts 6 are guided, as shown in FIG. 7, are formed in the vertical wall extending between the upper and lower levels 32 and 42, respectively defining the step junction surface. The first cover member 202 is formed with staggered conductor portion receiving apertures 212, similar to those of the first example and, in addition, a single row of through apertures receiving the conductor connecting portions of the terminals 7 in guiding and supporting engagement. The longitudinally extending side of the cover member provides a guide surface engaging the conductor connecting portions of the terminals 6, during and after termination, in a similar manner to the first example. In other respects the cover member 202 is similar to that of the first example and includes cable locating grooves 232 on a cable locating surface.

This construction of cover member is advantageous when compared with cover members of the prior art in which two rows of conductor connecting portion receiving apertures are provided for the conductor connection portions 6*a* and 7*a* of the terminal 6 and 7 as, in the prior art construction, a zig-zag dimensional offset is produced by deviations in the manufacturing processes of the connectors 6 and 7 which would make it difficult to insert the connector 10 into such cover member. The problems associated with such misalignment are avoided with the current example since it is only necessary to insert only a single row of conductor connecting portions 7*a* into only a single row of apertures 202*a* which can be accomplished smoothly.

Figure 9:
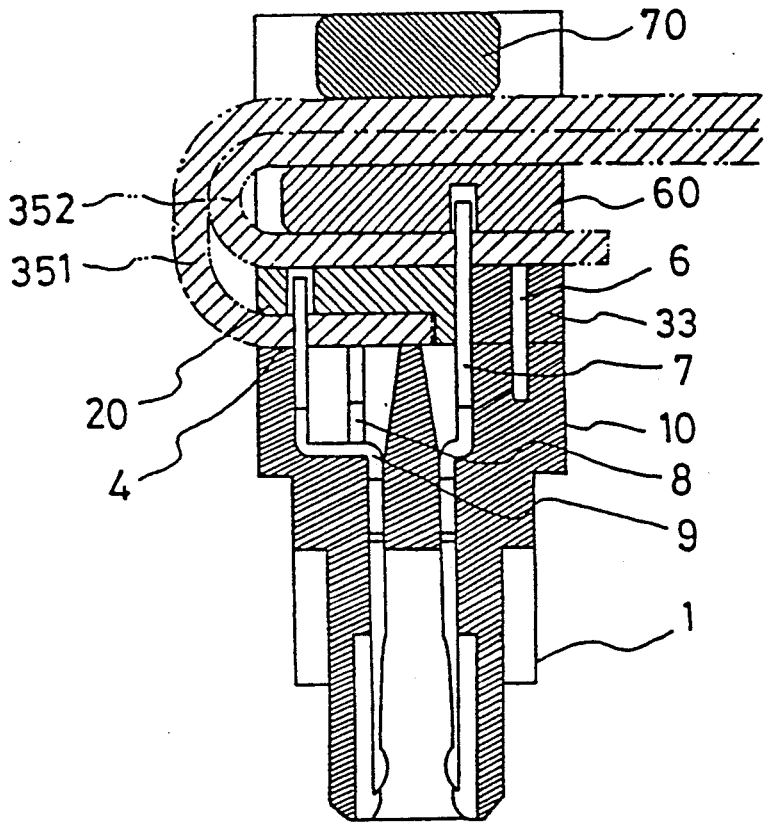
FIG. 9 is a diagrammatic, cross sectional view taken in a vertical transverse plane of a third example of connector according to the invention.
Figure 10A:
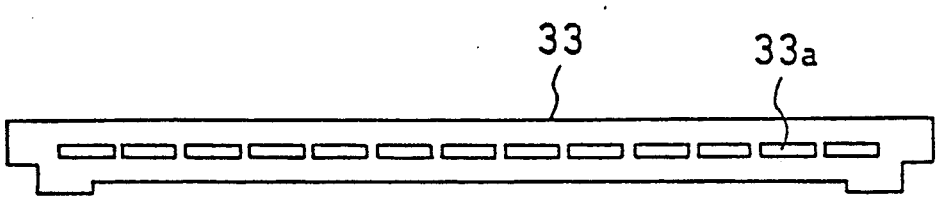
FIGS. 10(*a*),(*b*),(*c*),(*d*) and (*e*) are, respectively, plan, side elevational, underplan, end elevational and cross sectional views taken along line Z—Z of FIG. 10(*b*), of a step forming insert of the third example of connector shown in FIG. 9.
Figure 10B:
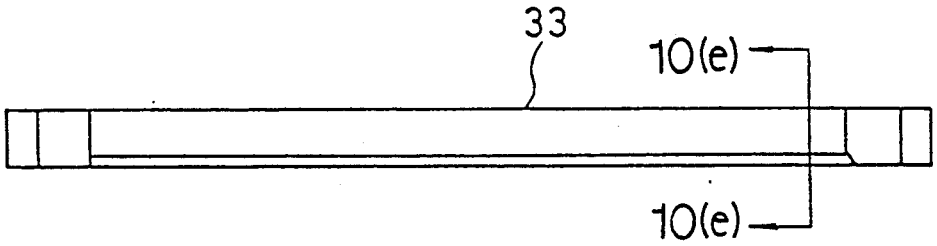
Figure 10C:
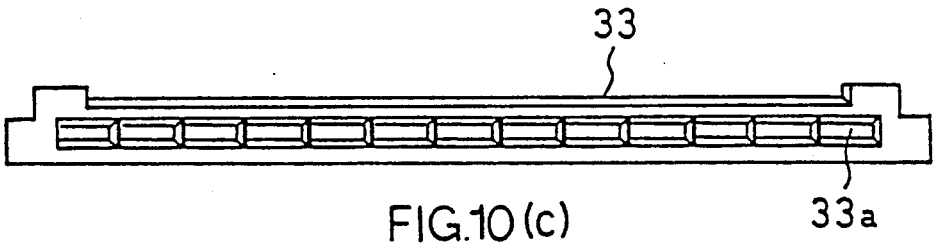
Figure 10D:
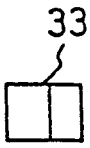
Figure 10E:
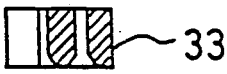

In the third example of connector according to the invention shown in FIGS. 9 and 10, the step portion is formed separately as an insert, not integrally when the housing 1 was formed originally, as in the earlier examples described above. Instead, a step-forming part 33 is manufactured separately and mounted onto the flat cable engaging surface of the housing prior to terminating the cables. The step forming insert 33 is formed with conductor connection portion receiving through-apertures 33*a* receiving and supporting conductor connecting portions 6*a* of the terminal 6, a longitudinally extended edge of the step-forming insert engages an otherwise unsupported face or side of each conductor connecting portion of the row of terminals 7. The cover member 20 has a structure similar to that shown in FIG. 5, providing similar functional advantages.

Figure 11:
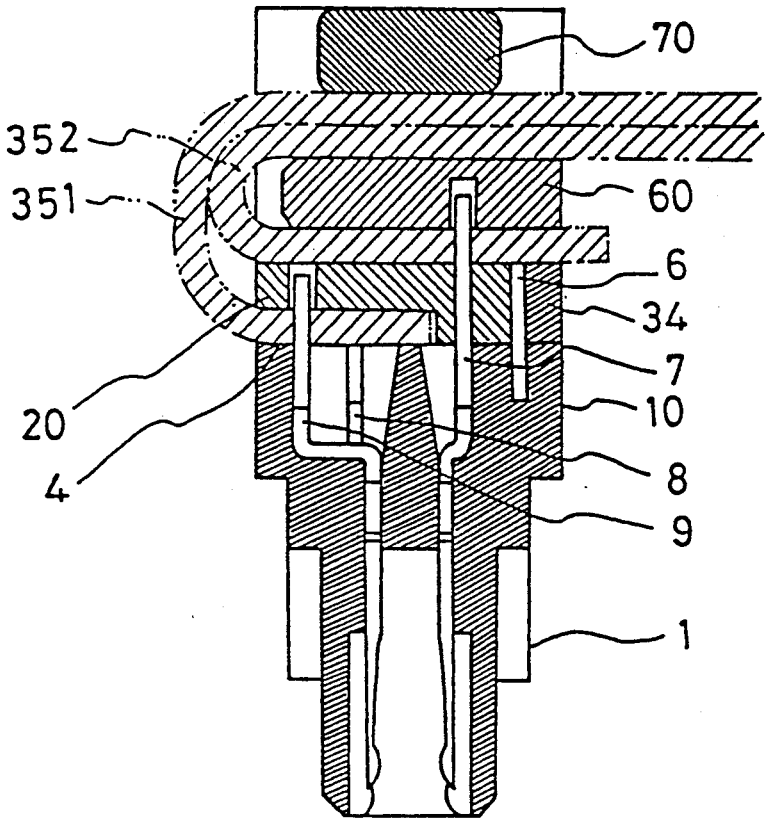
FIG. 11 is a diagrammatic cross sectional view taken in a vertical transverse plane of a fourth example of connector according to the invention.
Figure 13A:
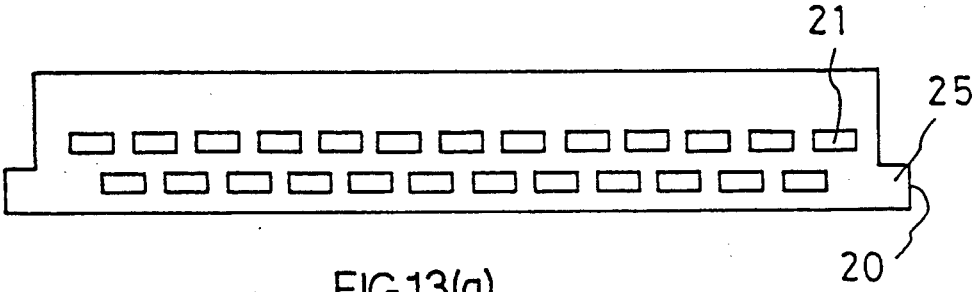
Figure 13B:
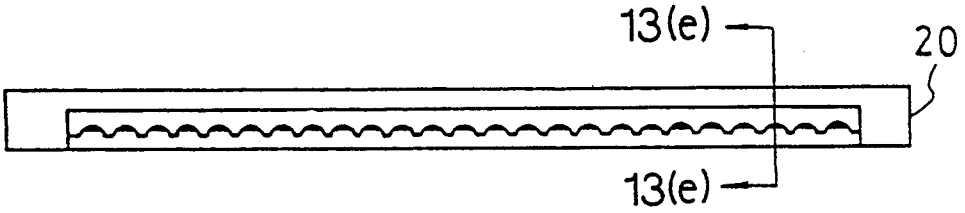
Figure 13C:
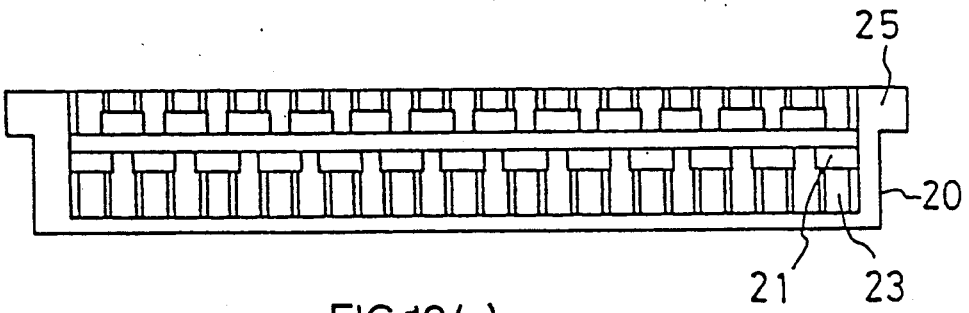
Figure 13D:
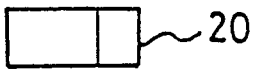
Figure 13E:
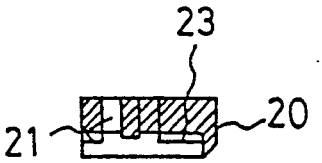

According to a fourth example of the invention shown in FIGS. 11 and 12, a step forming insert 34 is mounted on the cable engaging face, in supporting engagement with conductor connecting portions of terminals 6, prior to termination. The step forming insert 34 can be formed with channel section terminal supporting surfaces extending along one longitudinal edge thereof or, as shown in FIG. 12, with conductor connecting portion receiving through apertures 34*a* receiving and supporting conductor connecting portions of the terminals 6 prior to termination. In this example, the cover member 20 has the same structure as that shown in FIG. 8, providing the same functional effects and advantages.

Figure 14:
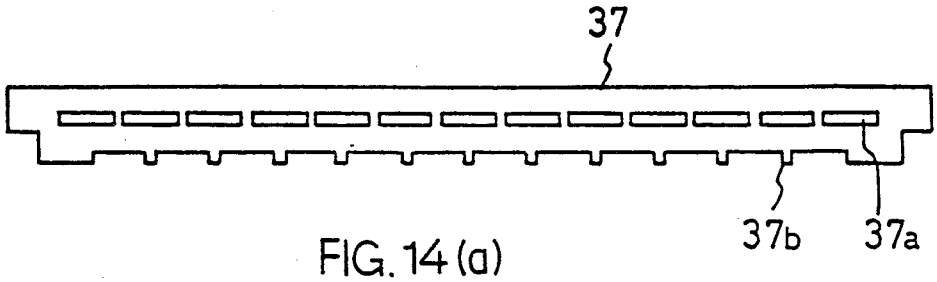
FIGS. 14 (*a*),(*b*),(*c*),(*d*) and (*e*) are, respectively, plan, side elevational, underplan, end elevational and cross sectional view take along line W—W of FIG. 14(*b*), showing a further step forming insert of a fifth example of a connector according to the invention.
Figure 14B:
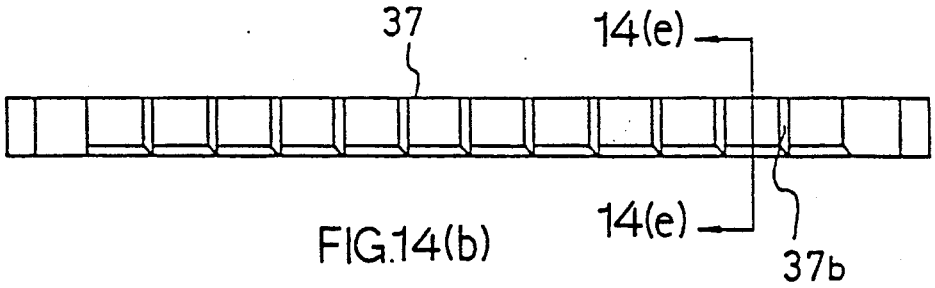
Figure 14:
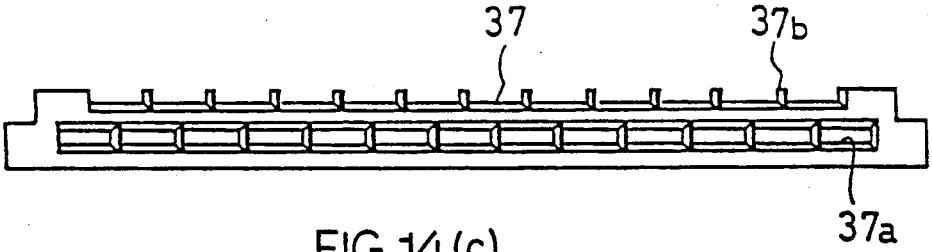
Figure 14D:
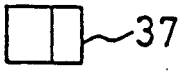
Figure 14:
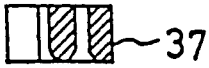

According to a fifth example of the invention shown in FIGS. 13 and 14, a step forming insert 37 is formed with through-apertures 37*a* for receiving conductor connection portions of terminals 6 and channel section supports defined by a longitudinal edge of the insert and a series of protrusions 37*b* extending transversely therefrom for receipt between adjacent conductor connection portions 7*a* of terminals 7 of the second series. In this example the cover member 20 has two rows of conductor connecting receiving portion through-apertures, the apertures of one row being offset from the apertures of the other row i.e., staggered in zig-zag fashion, aligned to receive conductor connecting portions 8*a* and 9*a* of the terminals 8 and 9 of the first series, during termination. Similar functional effects and advantages are obtained as those of the second example.

It will be appreciated that, although all the examples of the invention disclose receptacles, the connectors may also be of the DIP or the card edge type. Furthermore, the step forming inserts 33, 34 and 37 which prevent deformation of the conductor connecting portions of the terminals 6 and 7, which were used in the third, fourth and fifth examples may also be adapted to be adhered to the cable connecting surface 2 of the housing 1 prior to termination. It is also possible for connectors of the invention to include five or more rows of contacts and to terminate three or more separate flat cables. Additionally, apertures may replace projections or bosses and vice versa.

As a result of the provision of the guiding and supporting surfaces of the first cover member, unsupported lengths of the conductor connecting portions of the terminals are guided and supported during and after termination, substantially reducing or eliminating risk of deformation thereof. The formation of the step as a separate insert enables a simplification in the manufacture and assembly of the terminals in the housing. The invention therefore provides connectors in which both the positional accuracy of the conductor connecting parts can be maintained constant to enable the high density of connection necessary for a compact structure with virtually zero defects for utilization in micro-miniaturized electronic devices and facilitates mass production at high volume consistent with low production and assembly costs, essential for commercial success in an extremely competitive world marketplace.

We claim:

1. A flat cable connector for establishing permanent connection with respective individual conductors of first and second flat cable end portions stacked in overlapping relation one above the other comprising:

an elongate insulating housing having an elongate cable connecting face and a contact face, the cable connecting face being divided laterally by a longitudinally extending step into lower and upper cable supporting surfaces providing longitudinally extending lower and upper cable termination zones;

a first and a second series of terminals each stamped and formed in one piece with conductor connecting and contact portions adjacent respective opposite ends thereof, each conductor connecting portion comprising a plate portion having opposite faces and formed with a wire receiving slot extending between the faces, the plate portions of terminals of the second series being longer than those of the first series, the terminals being anchored in the housing with the faces of the plate portions of the first and second series extending in parallel planes longitudinally of the connector and protruding above the lower and upper surfaces of the cable connecting face, respectively, with respective conductor receiving slots in lower and upper termination zones respectively, at least some of the plate portions of the second series being arranged in a row upstanding perpendicularly from the lower surface of the step at the same level as the plate portions of the first series with one face supportingly engaged by a vertical wall of the step, and the opposite face unsupported by the housing in at least one lateral direction towards the first series of terminals;

first and second, elongate, cover members for receipt in the lower and upper termination zones, respectively, and having cable engaging faces with means for engaging the first and second cables, respectively, with an end portion of the second cable trapped between the second and first cover members and the upper surface of the cable connecting face, and an end portion of the first cable trapped between the first cover member and the lower surface of the cable connecting face, to force respective conductors thereof into respective wire receiving slots of terminals of the first and second series on terminating movement of the housing and cables relatively together, the first cover member being of less lateral width than the cable connecting face and having a longitudinally extending, laterally facing, free edge portion extending perpendicularly away from the cable engaging face forming terminal guide surface means such that, during terminating movement, the terminal guide surface means of the first cover member is in sliding engagement with the unsupported faces of the plate portions of extended length throughout their terminating movement relatively towards the second cable maintaining the plate portions upstanding perpendicularly throughout terminating movement and providing supporting engagement therewith after terminating movement.

2. A flat cable connector according to claim 1 in which a series of guide projections extend laterally from one of the edge portion of the cover member and the vertical wall of the step at longitudinally spaced intervals corresponding to the longitudinal spacing of the conductor connecting portions of the terminals of the second series and are received between unsupported longitudinally facing edges of adjacent conductor connecting portions of the terminals.

3. A flat cable connector according to claim 1 or claim 2 in which alternate conductor connecting portions of the first series of terminals are staggered laterally of the connector, zig-zag fashion, to form two rows and the first cover member is formed with correspondingly staggered, conductor connection portion receiving apertures.

4. A flat cable connector according to claim 1 in which the terminals are anchored at locations in the housing equidistant from the lower level of the cable connecting face.

5. A flat cable connector according to claim 1 in which others of the plate portions of the second series upstand in a second row from the lower level and are spaced laterally from the step and terminal guide surface means are formed by edges of respective apertures which extend through the first cover member in a row aligned for receiving the respective conductor connecting portions of the row of the second series of terminals.

6. A flat cable connector according to any one of claims 1, 2 or 5 in which the step providing the upper level is formed as a separate insert mounted on the cable connecting face of the housing prior to termination and comprising an elongate strip of insulating material having an elongate, housing engaging face opposite a second, cable engaging face and terminal supporting means located along the insert and comprising at least one of a row of conductor connecting portion receiving apertures and channels extending through the insert between the housing engaging and second cable engaging faces for supporting engagement with conductor connecting portions of the row of other terminals of the second series of terminals.

7. A flat cable connector according to claim 6 when dependent on claim 1 in which the terminal supporting means comprises both a row of said conductor connecting portion receiving apertures and a row of said conductor connecting portion receiving channels, the row of conductor connecting portion receiving apertures receiving conductor connecting portions of the other terminals of the second series in supporting engagement and said row of conductor connecting portion receiving channels receiving the conductor connecting portions of said at least some terminals of the second series in supporting engagement.

8. A flat cable connector according to claim 1 in which other of the plate portions of the second series are arranged in another row upstanding, supported by the housing, from the upper surface adjacent the step into the upper cable termination zone.

9. A flat cable connector according to claim 8 in which the step and housing are integrally formed in one piece.

* * * * *